US009020388B2

(12) United States Patent
Fukuchi et al.

(10) Patent No.: US 9,020,388 B2
(45) Date of Patent: Apr. 28, 2015

(54) IMAGE FORMING APPARATUS

(71) Applicants: Isao Fukuchi, Gifu (JP); Atsushi Fukui, Toyota (JP); Masanori Tsuruko, Nagoya (JP); Akihiro Kobayashi, Kakamigahara (JP)

(72) Inventors: Isao Fukuchi, Gifu (JP); Atsushi Fukui, Toyota (JP); Masanori Tsuruko, Nagoya (JP); Akihiro Kobayashi, Kakamigahara (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 14 days.

(21) Appl. No.: 14/039,838

(22) Filed: Sep. 27, 2013

(65) Prior Publication Data

US 2014/0093275 A1 Apr. 3, 2014

(30) Foreign Application Priority Data

Sep. 28, 2012 (JP) ..... 2012-218495

(51) Int. Cl.
*G03G 21/00* (2006.01)
*G03G 21/16* (2006.01)

(52) U.S. Cl.
CPC ..... *G03G 21/0011* (2013.01); *G03G 21/169* (2013.01); *G03G 2215/0141* (2013.01); *G03G 2221/0042* (2013.01)

(58) Field of Classification Search
CPC ..... G03G 21/169; G03G 21/0011; G03G 2221/0042; G03G 2215/0141
USPC ..... 399/358, 350, 357, 99, 111
See application file for complete search history.

(56) References Cited

U.S. PATENT DOCUMENTS

| | | | | |
|---|---|---|---|---|
| 7,840,157 | B2 * | 11/2010 | Nakatake et al. | 399/357 |
| 7,995,960 | B2 | 8/2011 | Kamimura | |
| 2009/0169258 | A1 | 7/2009 | Kamimura | |
| 2013/0322902 | A1 * | 12/2013 | Miyahara et al. | |

FOREIGN PATENT DOCUMENTS

| | | |
|---|---|---|
| JP | 2009-157310 A | 7/2009 |

* cited by examiner

*Primary Examiner* — Susan Lee
(74) *Attorney, Agent, or Firm* — Banner & Witcoff, Ltd.

(57) ABSTRACT

An image forming apparatus includes a first process unit and a second process unit. The first process unit includes: a first photosensitive member configured to carry a first developer image to be transferred onto a transfer medium; and a blade member configured to scrape substances attached to a surface of the first photosensitive member off the surface of the first photosensitive member. The second process unit includes: a second photosensitive member configured to carry a second developer image to be transferred onto the transfer medium having the first developer image transferred thereon; and a holding member configured to remove substances attached to a surface of the second photosensitive member from the surface of the second photosensitive member, temporarily hold the substances and return the substances to the surface of the second photosensitive member.

16 Claims, 2 Drawing Sheets

IMAGE FORMING APPARATUS

CROSS-REFERENCE TO RELATED APPLICATIONS

This application claims priority from Japanese Patent Application No. 2012-218495 filed on Sep. 28, 2012 the entire subject matter of which is incorporated herein by reference.

TECHNICAL FIELD

Illustrative aspects of the present invention relate to an image forming apparatus using an electrophotographic method.

BACKGROUND

As an electrophotographic image forming apparatus, there is known a tandem type color printer having a plurality of photosensitive drums corresponding to colors (for example, yellow, magenta, cyan and black).

As this tandem type color printer, there is known a color printer having cleaning rollers for removing substances such as paper dust and residual toner attached to photosensitive drums.

Incidentally, in this color printer, it is most likely for paper dust to be attached to a photosensitive drum provided on the upstream side in a sheet conveyance direction.

For this reason, there has been proposed an image forming apparatus having a configuration in which a shaft for collecting attached substances such as paper dust and residual toner from a cleaning roller is provided only for a cleaning roller corresponding to a photosensitive drum provided on the upstream side in a sheet conveyance direction.

SUMMARY

In the above-described related-art color printer, however, many substances may be attached to the photosensitive drum provided on the upstream side in the sheet conveyance direction, because an amount of paper dust may vary according to the surrounding environment, such as humidity or temperature, and the type of paper, or an amount of residual toner of the photosensitive drum provided on the upstream side in the sheet conveyance direction may vary according to a frequency of use thereof.

For this reason, it may not be sufficient to collect substances such as paper dust and residual toner attached to the photosensitive drum.

Specifically, paper dust, which is different from toner, widely varies due to characteristics of the paper dust such as shapes, sizes, and charging characteristics. For this reason, it is difficult for the cleaning roller to completely collect paper dust. Further, in a case of using a foam member as the cleaning roller, paper dust may cling to a surface of the cleaning roller and may cause a problem of the paper dust entering into the foam member.

If an image forming operation is performed in a state where substances such as paper dust and residual toner are attached to the photosensitive drum, those substances may be attached to a sheet or be collected into a toner accommodating chamber, resulting in image formation defects such as deterioration of toner.

Therefore, illustrative aspects of the present invention provide an image forming apparatus capable of suppressing image forming defects.

According to one illustrative aspect of the present invention, there is provided an image forming apparatus comprising: a housing; a first process unit provided inside the housing; and a second process unit provided inside the housing.

The first process unit comprises: a first photosensitive member configured to carry a first developer image to be transferred onto a transfer medium; and a blade member configured to scrape substances attached to a surface of the first photosensitive member off the surface of the first photosensitive member.

The second process unit comprises: a second photosensitive member configured to carry a second developer image to be transferred onto the transfer medium on which the first developer image is configured to have been transferred; and a holding member configured to: remove substances attached to a surface of the second photosensitive member from the surface of the second photosensitive member; temporarily hold the substances; and return the substances to the surface of the second photosensitive member.

According to this configuration, the first photosensitive member transfers a developer image onto the transfer medium, earlier than the second photosensitive member. Therefore, it is more likely for substances such as paper dust and residual toner to be attached to the first photosensitive member, as compared to the second photosensitive member.

For this reason, in the first process unit, substances attached to the surface of the first photosensitive member are scraped off the surface of the first photosensitive member by the blade member. In this way, it is possible to reliably remove the attached substances.

As a result, it is possible to reliably remove more substances such as paper dust and residual toner attached to the surface of the first photosensitive member from the surface of the first photosensitive member by the blade member, as compared to the second photosensitive member, and to suppress image formation defects.

DETAILED DESCRIPTION

Exemplary embodiments will now be described with reference to the drawings.

First Exemplary Embodiment

1. Overall Configuration of Printer

Figure 1:
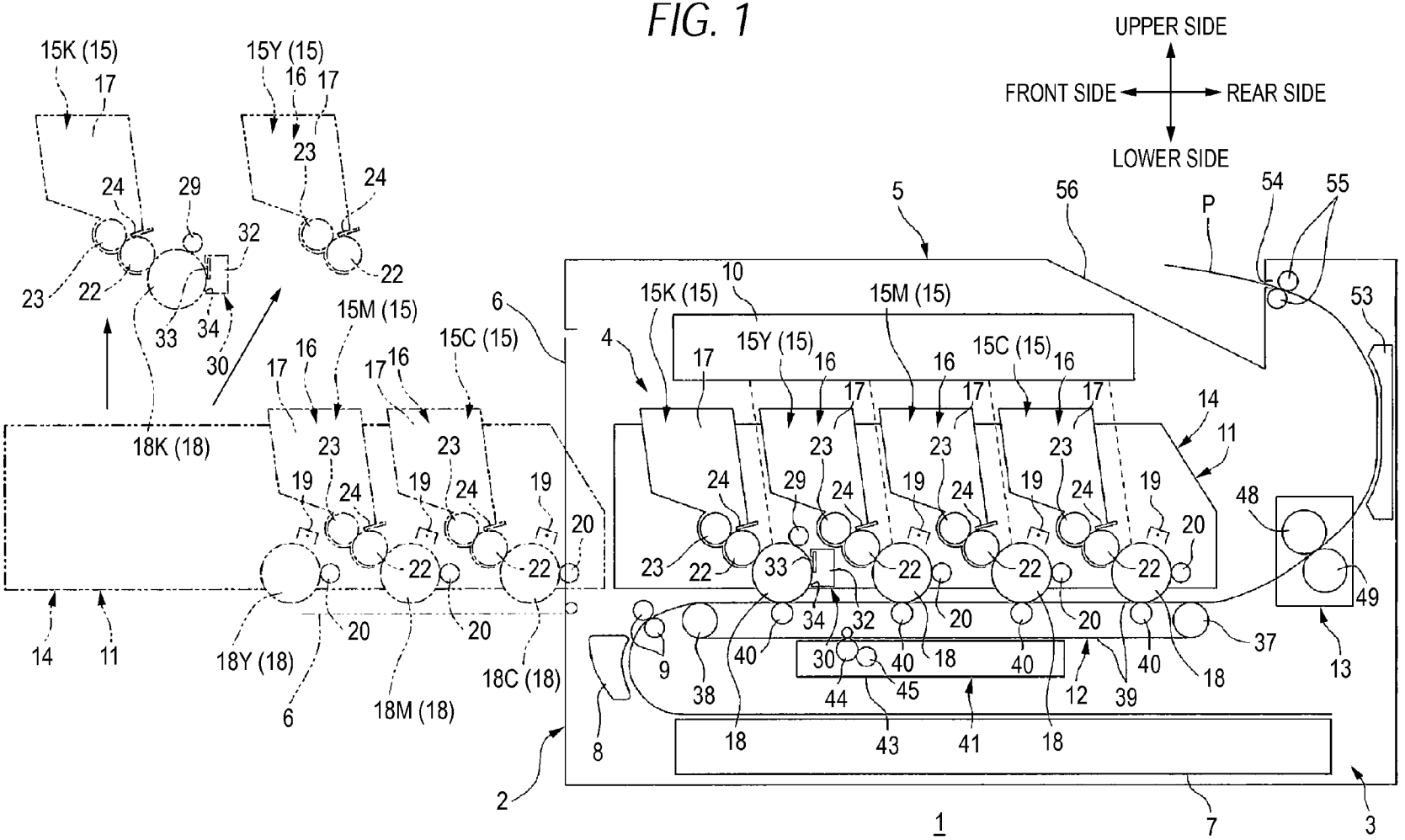
FIG. 1 is a sectional side view illustrating a printer according to a first exemplary embodiment.

As shown in FIG. 1, a printer 1 which is an example of an image forming apparatus is a transverse direct-tandem type color laser printer. The printer 1 includes: a sheet feeding unit 3 for feeding a sheet P as an example of a transfer medium; an image forming unit 4 for forming images on the fed sheet P; and a sheet discharging unit 5 for discharging the sheet P having the images formed thereon, inside a main body casing 2 which is an example of a housing.

(1) Main Body Casing

The main body casing 2 is formed substantially in a box shape as seen in a side view. The main body casing 2 accommodates the sheet feeding unit 3 and the image forming unit 4. A front cover 6 for installing and removing a drawer unit (which will be described later) is formed on one side wall of the main body casing 2. The front cover 6 is provided to be able to swing on its lower end portion with respect to the main body casing 2.

In the following description, when directions are stated with respect to the printer 1, the upper side and lower side of the printer refer to a state where the printer 1 is horizontally installed. Specifically, the upper side of the drawing sheet of FIG. 1 is referred to as the upper side of the printer 1 (one side in a first direction (a vertical direction)) and the lower side of the drawing sheet of FIG. 1 is referred to as the lower side of the printer 1 (the other side in the first direction (the vertical direction)). Further, the side where the front cover 6 is provided (the left side of the drawing sheet of FIG. 1) is referred to the front side of the printer 1 (one side in a second direction (a front-rear direction)), and the opposite side (the right side of the drawing sheet of FIG. 1) is referred to as the rear side of the printer 1 (the other side in the second direction (the front-rear direction)). Furthermore, the left side and right side of the printer 1 refer to the state of the printer as seen from the front side. That is, a direction toward a viewer of FIG. 1 is referred to as the right side of the printer (one side in a third direction (a left-right direction)), and a direction away from the viewer of FIG. 1 is referred to as the left side of the printer (the other side in the third direction (the left-right direction)).

(2) Sheet Feeding Unit

The sheet feeding unit 3 includes a sheet feeding tray 7 configured to store a sheet P. The sheet feeding tray 7 is removably installed at the bottom of the inside of the main body casing 2. A sheet feeding guide 8 and a pair of resist rollers 9 are provided on the upper front side of the sheet feeding tray 7.

Sheet P stored in the sheet feeding tray 7 is handled one at a time and is guided upward toward a gap between the pair of resist rollers 9 by the sheet feeding guide 8. Then, the sheet makes a U-turn toward the rear side and is conveyed toward the image forming unit 4 (gaps between photosensitive drums 18 (which will be described later) and a conveyor belt 39 (which will be described later)) at predetermined timings.

(3) Image Forming Unit

The image forming unit 4 includes a scanner unit 10, a drawer unit 11, a transfer unit 12 and a fixing unit 13.

(3-1) Scanner Unit

The scanner unit 10 is provided at an upper portion of the main body casing 2. On the basis of image data, the scanner unit 10 emits laser beams toward all (four) photosensitive drums 18 (which will be described later) as shown by broken lines, thereby exposing the photosensitive drums 18 (which will be described later).

(3-2) Drawer Unit (3-2-1) Configuration of Drawer Unit

The drawer unit 11 is provided below the scanner unit 10 and above the transfer unit 12. The drawer unit 11 includes: a drawer frame 14 as an example of a supporting member; and a plurality of (four) process units 15.

The drawer frame 14 is slidable along in the front-rear direction between an inside position (see a solid line in FIG. 1) where it is provided inside the main body casing 2 and an outside position (see a virtual line in FIG. 1) where it is drawn out of the main body casing 2. The drawer frame 14 is formed substantially in a box shape open upward and downward.

The plurality of process units 15 is provided in parallel at intervals in the front-rear direction. Specifically, from the front side of the drawer frame 14 toward the rear side of the drawer frame 14, a black process unit 15K, a yellow process unit 15Y, a magenta process unit 15M and a cyan process unit 15C are sequentially provided. The black process unit 15K is configured as one example of a first process unit, and the yellow process unit 15Y, the magenta process unit 15M and the cyan process unit 15C are configured as one example of a second process unit. Incidentally, the yellow process unit 15Y, the magenta process unit 15M and the cyan process unit 15C are generally referred to as color process units 15.

Each process unit 15 includes a photosensitive drum 18, a toner accommodating unit 17, a developing roller 22, a feeding roller 23 and a layer-thickness regulating blade 24.

The black process unit 15K includes a charging roller 29 (an example of a first charging member). Each color process unit 15 includes a scorotron charger 19 (an example of a second charging member).

The photosensitive drums 18 are formed in a substantially cylindrical shape extending in the left-right direction. The lower end portions of the photosensitive drums 18 are exposed from the drawer frame 14. Incidentally, a photosensitive drum 18 provided in the black process unit 15K is configured as an example of a first photosensitive member, and photosensitive drums 18 provided in the color process units 15 are configured as examples of a second photosensitive member.

The toner accommodating units 17 are formed substantially in a box shape extending in the left-right direction. The toner accommodating units 17 are provided such that the upper end portions of the toner accommodating units 17 are exposed from the drawer frame 14. Incidentally, a toner accommodating unit 17 provided in the black process unit 15K is configured as an example of a first developer accommodating unit, and toner accommodating units 17 provided in the color process units 15 are configured as examples of a second developer accommodating unit.

The developing rollers 22 are provided on the upper front sides of the photosensitive drums 18 such that the developing rollers 22 are configured to be in contact with the photosensitive drums 18.

The feeding rollers 23 are provided on the upper front sides of the developing rollers 22 such that the feeding rollers 23 are configured to be in contact with the developing rollers 22.

The layer-thickness regulating blades 24 are provided such that they come into contact with the developing rollers 22 from the upper side so as to regulate thickness of toner fed on the developing rollers 22.

The charging roller 29 is provided on the upper rear side of the photosensitive drum 18 provided in the black process unit 15K and is pressed against the photosensitive drum 18 from the upper rear side.

The plurality of scorotron chargers 19 are provided on the upper rear sides of the photosensitive drums 18 provided in the color process units 15 such that they face the photosensitive drums 18 with gaps, respectively.

(3-2-2) Developing Operation in Drawer Unit

The toner accommodated in the toner accommodating units 17 is fed onto the feeding rollers 23. The toner is then fed onto the developing rollers 22 and is triboelectrically and positively charged between the feeding rollers 23 and the developing rollers 22.

According to rotating of the developing rollers 22, the thicknesses of the toner fed on the developing rollers 22 are regulated by the layer-thickness regulating blades 24, such that the toner is carried, as thin layers having a constant thickness, on the surfaces of the developing rollers 22.

The surface of a black photosensitive drum 18K is uniformly charged by rotating of the charging roller 29. Further, according to rotating of a yellow photosensitive drum 18Y, a magenta photosensitive drum 18M and a cyan photosensitive drum 18C, the surfaces of the yellow photosensitive drum 18Y, the magenta photosensitive drum 18M and the cyan photosensitive drum 18C are uniformly charged by the scorotron chargers 19.

Then, the charged photosensitive drums 18 are exposed at a high speed by laser beams from the scanner unit 10. As a result, electrostatic latent images corresponding to an image to be formed on a sheet P are formed on the surfaces of the photosensitive drums 18.

When the photosensitive drums 18 further rotate, the positively charged toner carried on the surfaces of the developing rollers 22 is fed to the electrostatic latent images formed on the surfaces of the developing cartridges 10. As a result, the electrostatic latent images on the photosensitive drums 18 are visualized, that is, toner images based on reversal development are carried on the surfaces of the photosensitive drums 18. A toner image which is carried on the black photosensitive drum 18K is configured as an example of a first developer image, and toner images which are carried on the yellow photosensitive drum 18Y, the magenta photosensitive drum 18M and the cyan photosensitive drum 18C are configured as examples of a second developer image.

(3-3) Transfer Unit

The transfer unit 12 is provided along the front-rear direction above the sheet feeding unit 3 and below the drawer unit 11 inside the main body casing 2. The transfer unit 12 includes a driving roller 37, a driven roller 38, the conveyor belt 39 which is an example of a belt, and a plurality of (four) transfer rollers 40.

The driving roller 37 and the driven roller 38 are provided to face each other having a space therebetween in the front-rear direction.

The conveyor belt 39 is wound around the driving roller 37 and the driven roller 38 such that the conveyor belt faces the plurality of photosensitive drums 18 in the vertical direction, and that the upper portion of the conveyor belt is in contact with the plurality of photosensitive drums 18. Further, driving of the driving roller 37 causes the conveyor belt 39 to circulate substantially clockwise as seen in a right side view such that the upper portion of the conveyor belt 39 being in contact with the plurality of photosensitive drums 18 moves from the front side toward the rear side.

The plurality of transfer rollers 40 is provided to face the plurality of photosensitive drums 18, respectively, with the upper portion of the conveyor belt 39 interposed therebetween.

Then, a sheet P fed from the sheet feeding unit 3 is conveyed from the front side toward the rear side by the conveyor belt 39 such that the sheet sequentially passes through transfer positions where the photosensitive drums 18 and the transfer rollers 40 face each other. During the conveying, the toner images of the individual colors carried on the plurality of photosensitive drums 18 are sequentially transferred onto the sheet P, whereby a color image is formed.

(3-4) Fixing Unit

The fixing unit 13 is provided posterior to the transfer unit 12. The fixing unit 13 includes a heating roller 48 and a pressing roller 49 that faces the heating roller 48. When the sheet P passes through the gap between the heating roller 48 and the pressing roller 49, the color image having been transferred onto the sheet P in the transfer unit 12 is heated while being pressed, thereby thermally fixed on the sheet P.

(4) Sheet Discharging Unit

At an upper portion of the main body casing 2, the sheet discharging unit 5 is formed in substantially V-shape open upward as seen in a side view. The sheet discharging unit 5 includes a sheet discharging guide 53, an outlet 54, a pair of sheet discharging rollers 55 and a sheet discharge tray 56.

The sheet discharging guide 53 is provided inside the rear end portion of the sheet discharging unit 5.

The outlet 54 is formed at the front surface of the rear end portion of the sheet discharging unit 5 so as to connect the inside and outside of the main body casing 2.

The pair of sheet discharging rollers 55 is provided to face each other in the vertical direction such that a sheet P discharged from the outlet 54 can be inserted therebetween in the vertical direction.

The sheet discharge tray 56 is provided at the top of the main body casing 2 anterior to the outlet 54.

The sheet P having the toner image thermally fixed in the fixing unit 13 is guided upward to the outlet 54 by the sheet discharging guide 53. Then, the sheet P makes a U-turn toward the front side and is discharged onto the sheet discharge tray 56 through the gap between the pair of sheet discharging rollers 55.

2. Drawer Unit (1) Details of Black Process Unit

The black process unit 15K includes the above-described photosensitive drum 18, the charging roller 29, the toner accommodating unit 17, the developing roller 22, the feeding roller 23, and the layer-thickness regulating blade 24. The black process unit 15K further includes a drum cleaning unit 30. Further, these components are integrally and removably installed at a front portion of the drawer frame 14.

The drum cleaning unit 30 includes a drum cleaner frame 32, which is an example of a retaining unit, and a drum cleaning blade 33 that is an example of a blade member.

The drum cleaner frame 32 is provided posterior to the photosensitive drum 18 and on the lower rear side on the charging roller 29. The drum cleaner frame 32 is formed substantially in a square tube shape extending in the left-right direction. At the drum cleaner frame 32, an opening 34 is formed.

The opening 34 is formed through the center of the front wall of the drum cleaner frame 32 in the vertical direction, in the left-right direction of the drum cleaner frame 32.

The drum cleaning blade 33 is provided at the front end portion of the drum cleaner frame 32. The drum cleaning blade 33 is formed in a substantially flat plate shape having a thickness in the front-rear direction and extending in the left-right direction. The upper portion of the drum cleaning blade 33 is fixed to the upper periphery of the opening 34 of the drum cleaner frame 32. The lower portion of the drum cleaning blade 33 faces the upper portion of the opening 34 of the drum cleaner frame 32. Further, the lower end portion of the drum cleaning blade 33 is in contact with the rear side of the photosensitive drum 18.

As described above, the photosensitive drum 18, the charging roller 29, the toner accommodating unit 17, the developing roller 22, the feeding roller 23, the layer-thickness regulating blade 24, and the drum cleaning unit 30 can be integrally mounted to and removed from the drawer frame 14.

(2) Details of Color Process Units

Each color process unit 15 includes a developing cartridge 16.

The developing cartridges 16 are removably mounted to the drawer frame 14 such that the developing cartridges 16 are supported on the drawer unit 11. Further, each developing cartridge 16 includes the above-described toner accommodating unit 17, developing roller 22, feeding roller 23 and layer-thickness regulating blade 24.

Further, each color process unit 15 includes the above-described photosensitive drum 18 and scorotron charger 19, and further includes a drum cleaning roller 20.

The photosensitive drums 18 and the scorotron chargers 19 are fixed to the drawer frame 14 such that they are provided in such a manner as to be unable to be removed from the drawer frame 14.

The drum cleaning rollers 20 are formed in a substantially cylindrical shape extending in the left-right direction. The drum cleaning rollers 20 are installed such that they face and are in contact with the rear sides of the photosensitive drums 18, respectively, in such a manner as to be unable to be removed therefrom.

As described above, unlike the black process unit 15K, in each color process unit 15, a developing cartridge 16, a photosensitive drum 18, a scorotron charger 19, and a drum cleaning roller 20 are installed as separate components, such that they can be removed from the drawer frame 14.

3. Details of Transfer Unit

The transfer unit 12 includes a belt cleaning unit 41 that is an example of a belt cleaner.

The belt cleaning unit 41 is provided below the conveyor belt 39. The belt cleaning unit 41 includes a belt cleaner frame 43, a belt cleaning roller 44 and a scraping roller 45.

The belt cleaner frame 43 is formed substantially in a rectangular box shape as seen in a side vide.

The belt cleaning roller 44 is formed in a substantially columnar shape extending in the left-right direction. The belt cleaning roller 44 is rotatably installed at the upper end of the inside of the belt cleaner frame 43.

The scraping roller 45 is formed in a substantially columnar shape extending in the left-right direction. The scraping roller 45 is rotatably installed inside the belt cleaner frame 43 such that the scraping roller is in contact with the lower rear side of the belt cleaning roller 44.

4. Cleaning Operation

In the printer 1, as described above, a sheet P is fed toward the image forming unit 4, and is conveyed from the front side toward the rear side by the conveyor belt 39 such that the sheet sequentially passes through the gaps between the photosensitive drums 18 and the transfer rollers 40, whereby an image is formed on the sheet P.

After performing the image forming, the printer 1 collects (removes) substances such as paper dust and residual toner attached to the photosensitive drums 18 before the next image forming.

Especially, it is likely for substances such as paper dust and residual toner to be attached to the photosensitive drum 18 of the black process unit 15K that is provided on the upstream side in the conveyance direction of a sheet P, as compared to the photosensitive drums 18 of the color process units 15.

Substances such as paper dust and residual toner attached to the photosensitive drum 18 of the black process unit 15K are scraped by the drum cleaning blade 33 being in contact with the rear side of the photosensitive drum 18 of the black process unit 15K, and is retained inside the drum cleaner frame 32 through the opening 34.

Further, substances such as paper dust and residual toner attached to the photosensitive drums 18 of the color process units 15 are transferred onto the peripheral surfaces of the drum cleaning rollers 20 due to a cleaning bias applied to the drum cleaning rollers 20 when the substances face the drum cleaning rollers 20 by rotating of the photosensitive drums 18, and are temporarily held on the drum cleaning rollers 20.

Then, the substances such as paper dust and residual toner temporarily held on the drum cleaning rollers 20 are collected by the belt cleaning unit 41 during an image forming operation.

Specifically, first, a reverse bias of the cleaning bias is applied to the drum cleaning rollers 20. Then, the substances such as paper dust and residual toner temporarily held on the drum cleaning rollers 20 are released from the drum cleaning rollers 20 onto the conveyor belt 39 through the photosensitive drums 18 of the color process units 15, thereby being collected.

Then, the substances such as paper dust and residual toner attached to the conveyor belt 39 pass below the transfer rollers 19 and reach the belt cleaning roller 44 by circulating of the conveyor belt 39.

Then, the substances such as paper dust and residual toner having been released from the drum cleaning rollers 20 onto the conveyor belt 39 are caught by the belt cleaning roller 44 due to the cleaning bias applied to the belt cleaning roller 44. Then, the substances caught by the belt cleaning roller 44 are scraped by the scraping roller 45 and are stored in the belt cleaner frame 43.

5. Advantages (1) According to the printer 1, as shown in FIG. 1, the photosensitive drum 18 of the black process unit 15K transfers an image onto a sheet P, earlier than the photosensitive drums 18 of the color process units 15. Therefore, it is more likely for substances such as paper dust and residual toner to be attached to the photosensitive drum 18 of the black process unit 15K as compared to the photosensitive drums 18 of the color process units 15.

For this reason, in the black process unit 15K, substances such as paper dust and residual toner attached to the surface of the photosensitive drum 18 are scraped off the surface of the photosensitive drum 18 by the drum cleaning blade 33. Therefore, it is possible to reliably removing the attached substances.

As a result, it is possible to reliably remove attached substances from the surface of the photosensitive drum 18 of the black process unit 15K, to which more substances such as paper dust and residual toner are attached as compared to the photosensitive drums 18 of the color process units 15, by the drum cleaning blade 33. Therefore, it is possible to suppress image formation defects.

On the other hand, in the color process units 15, the drum cleaning rollers 20 for temporarily holding attached substances are provided, and thus the drum cleaner frames 32 are unnecessary.

For this reason, it is possible to reduce a space for the color process units 15.

(2) According to the printer 1, as shown in FIG. 1, the black process unit 15K is provided with the drum cleaner frame 32 for retaining substances scraped off the surface of the photosensitive drum 18 by the drum cleaning blade 33. Therefore, it is possible to retain more substances such as paper dust and residual toner removed, as compared to the photosensitive drums 18 of the color process units 15.

For this reason, it is possible to prevent substances such as paper dust and residual toner scraped off the photosensitive drum 18 of the black process unit 15K by the drum cleaning blade 33 from being attached to a sheet P, and thus it is possible to suppress image formation defects.

(3) According to the printer 1, as shown in FIG. 1, the toner accommodating unit 17 and the drum cleaner frame 32 of the black process unit 15K can be integrally removed from the main body casing 2. Therefore, when the toner of the toner accommodating unit 17 runs out and the toner accommodating unit 17 is replaced, the drum cleaner frame 32 is also removed from the main body casing 2.

For this reason, in the black process unit 15K, it is possible to replace the drum cleaner frame 32 where substances removed from the surface of the photosensitive drum 18 are retained, at the timing of replacing the drum cleaner frame 32. Therefore, it is possible to make the drum cleaner frame 32 smaller.

As a result, even though the drum cleaner frame 32 is provided between the black process unit 15K and the color process units 15, it is possible to suppress the pitch between the photosensitive drum 18 of the black process unit 15K and the photosensitive drums 18 of the color process units 15 from increasing, and thus it is possible to reduce the size of the printer 1.

(4) According to the printer 1, in the color process units 15, since the drum cleaning rollers 20 are provided as shown in FIG. 1, drum cleaner frames 32 are not necessary.

For this reason, in the color process units 15, the long-life drum cleaning rollers 20 do not need to be replaced with the consumption of the toner, and can be replaced separately from the toner accommodating units 17. Therefore, it is possible to provide an environmentally friendly and low running cost printer 1.

(5) According to the printer 1, as shown in FIG. 1, the toner accommodating unit 17 and the photosensitive drum 18 of the black process unit 15K are integrally installed and removed with respect to the main body casing 2, whereas the toner accommodating units 17 and the photosensitive drums 18 of the color process units 15 are installed and removed as separate components with respect to the main body casing 2.

For this reason, it is possible to increase the frequency of replacement of the photosensitive drum 18 of the black process unit 15K to which it is likely for paper dust to be attached, and to decrease the frequency of replacement of the photosensitive drums 18 of the color process units 15 to which it is unlikely for paper dust to be attached.

As a result, it is possible to provide an environmentally friendly printer 1 suppressing occurrence of image formation defects.

(6) According to the printer 1, as shown in FIG. 1, the black process unit 15K includes the charging roller 29 configured to come into contact with the photosensitive drum 18, thereby charging the photosensitive drum 18. Therefore, it is possible to suppress occurrence of ozone.

Further, the charging roller 29 can suppress electric power cost such that the electric power cost is lower than those of the scorotron chargers 19 which are discharged to charge the photosensitive drums 18 of the color process units 15.

For this reason, it is possible to use the charging roller 29 to suppress occurrence of ozone, and to charge the photosensitive drum 18 of the black process unit 15K while reducing the electric power cost.

Further, since the scorotron chargers 19 which are contactless chargers are provided for the photosensitive drums 18 of the color process units 15, it is possible to prevent substances returned from the drum cleaning rollers 20 to the surfaces of the photosensitive drums 18 from being attached to the scorotron chargers 19.

(7) According to the printer 1, as shown in FIG. 1, the black process unit 15K includes the charging roller 29. Therefore, it is possible to more reliably suppress occurrence of ozone.

(8) According to the printer 1, since the scorotron chargers 19 are provided in the color process units 15 as shown in FIG. 1, it is possible to reduce friction which is generated with respect to the photosensitive drums 18 of the color process units 15. Therefore, it is possible to decrease the frequency of replacement of the photosensitive drums 18 of the color process units 15 as compared to the photosensitive drum 18 of the black process unit 15K.

(9) According to the printer 1, as shown in FIG. 1, substances removed from the photosensitive drums 18 of the color process units 15 by the drum cleaning rollers 20 are returned to the photosensitive drums 18 of the color process units 15, are collected by the conveyor belt 39, and are removed by the belt cleaning unit 41.

For this reason, it is possible to suppress substances from being accumulated on the drum cleaning rollers 20, and to prolong the lives of the drum cleaning rollers 20.

(10) According to the printer 1, as shown in FIG. 1, in the black process unit 15K, the drum cleaning blade 33 is provided. Therefore, it is possible to more reliably scrape substances such as paper dust and residual toner off the surface of the photosensitive drum 18 of the black process unit 15K.

(11) According to the printer 1, as shown in FIG. 1, in the color process units 15, the drum cleaning rollers 20 is able to rotate while being in contact with the photosensitive drums 18 of the color process units 15, so that it is possible to remove the attached substances such as paper dust and residual toner without damaging the surfaces of the photosensitive drums 18.

Second Exemplary Embodiment

In the above-described first exemplary embodiment, the printer 1 has been configured as a tandem type direct color printer. However, in a second exemplary embodiment, it is also possible to configure a printer 70 as an intermediate transfer type color printer.

Incidentally, in the printer 70 of the second exemplary embodiment, components identical to those of the printer 1 of the first exemplary embodiment are denoted by the same reference symbols, and the description thereof will be omitted.

(1) Printer

Figure 2:
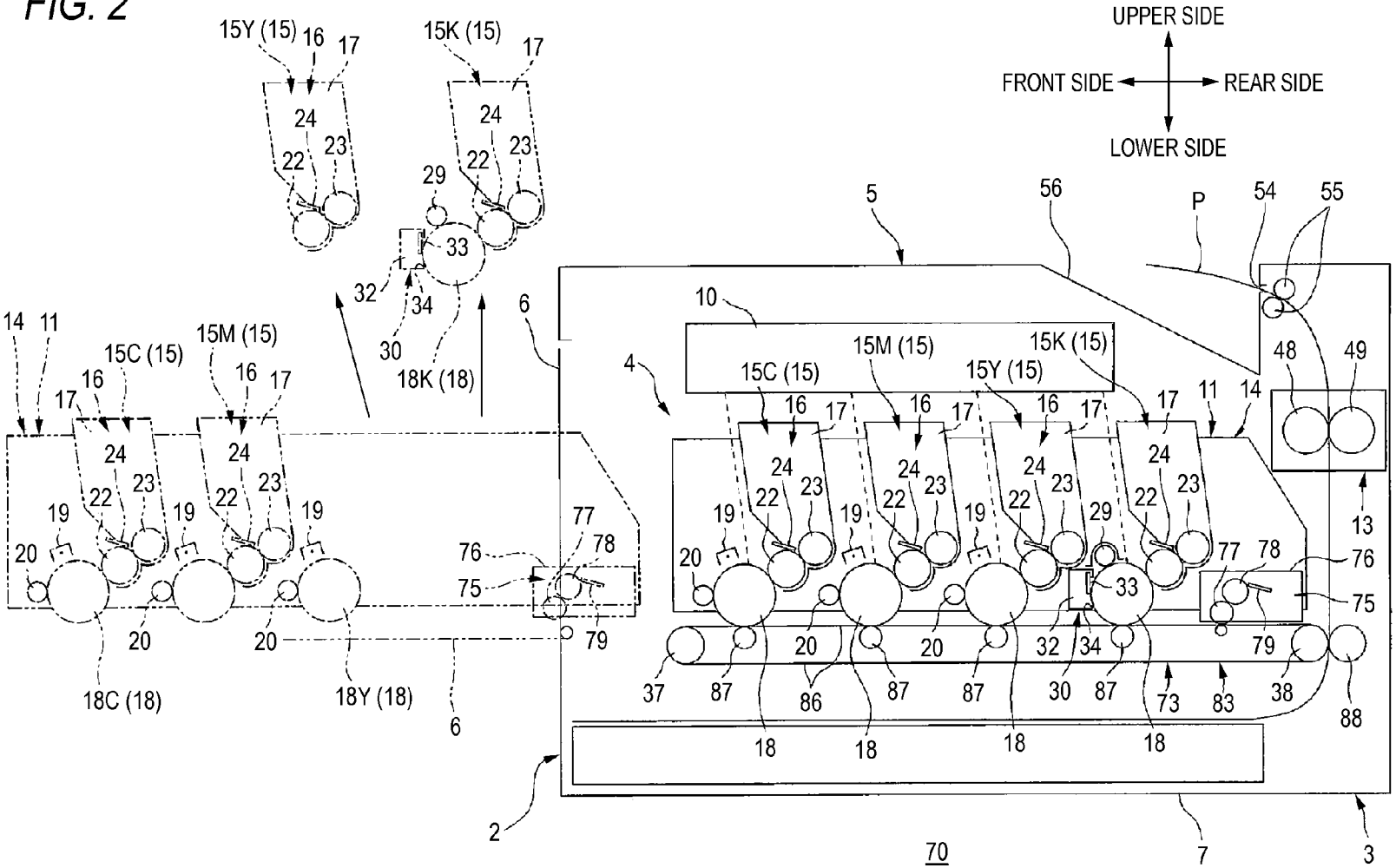
FIG. 2 is a sectional side view illustrating a printer according to a second exemplary embodiment.

As shown in FIG. 2, the printer 70 which is an example of an image forming apparatus is a transverse intermediate transfer type color printer. The printer 70 includes a sheet feeding unit 3 for feeding a sheet P and an image forming unit 4 for forming images on the fed sheet P, inside a main body casing 2.

A sheet P stored in a sheet feeding tray 7 of the sheet feeding unit 3 is fed one at a time, and is fed toward the image forming unit 4 (toward between an intermediate transfer belt 86 (which will be described later) and an intermediate transfer roller 88 (which will be described later)) at predetermined timings.

The image forming unit 4 is provided above the sheet feeding unit 3. The image forming unit 4 includes a drawer unit 11 and a transfer unit 73.

The drawer unit 11 includes a drawer frame 14 and a plurality of (four) process units 15.

The drawer frame 14 can slide along in the front-rear direction between an inside position (see a solid line in FIG. 2) where it is provided inside the main body casing 2 and an outside position (see a virtual line in FIG. 2) where it is drawn out of the main body casing 2.

The plurality of process units 15 is provided in parallel at intervals in the front-rear direction. Specifically, from the rear side of the drawer frame 14 toward the front side of the drawer frame 14, a black process unit 15K, a yellow process unit 15Y, a magenta process unit 15M and a cyan process unit 15C are sequentially provided.

The transfer unit 73 includes a belt unit 83 and a secondary transfer roller 88.

The belt unit 83 is provided along the front-rear direction below the drawer unit 11.

The belt unit 83 includes: a driving roller 37; a driven roller 38; the intermediate transfer belt 86 that is an example of the transfer medium and the belt; and a plurality of (four) primary transfer rollers 87.

The driving roller 37 and the driven roller 38 are provided to face each other with a space therebetween in the front-rear direction.

The intermediate transfer belt 86 is wound around the driving roller 37 and the driven roller 38 such that the conveyor belt faces the plurality of photosensitive drums 18 in the vertical direction, and that the upper portion of the conveyor belt is in contact with the plurality of photosensitive drums 18. Further, driving of the driving roller 37 causes the intermediate transfer belt 86 to circulate substantially counterclockwise as seen in a right side view such that the upper portion of the intermediate transfer belt 86 being in contact with the plurality of photosensitive drums 18 moves from the rear side toward the front side.

The plurality of primary transfer rollers 87 is provided to face the plurality of photosensitive drums 18, respectively, with the upper portion of the intermediate transfer belt 86 interposed therebetween.

The secondary transfer roller 88 is provided posterior to the belt unit 83, with the intermediate transfer belt 86 interposed between the secondary transfer roller 88 and the driven roller 38 of the belt unit 83.

(2) Drawer Unit

The drawer unit 11 includes a belt cleaning unit 75.

The belt cleaning unit 75 is fixed to the drawer frame 14 and is provided posterior to the black process unit 15K and on the rear end portion of the intermediate transfer belt 86. Further, the belt cleaning unit 75 includes a belt cleaner frame 76, a primary belt cleaning roller 77, a secondary belt cleaning roller 78 and a scraping blade 79.

The belt cleaner frame 76 is formed substantially in a rectangular box shape as seen in a side vide.

The primary belt cleaning roller 77 is formed in a substantially columnar shape extending in the left-right direction. The primary belt cleaning roller 77 is rotatably installed at the lower end of the inside of the belt cleaner frame 76.

The secondary belt cleaning roller 78 is formed in a substantially columnar shape extending in the left-right direction. The secondary belt cleaning roller 78 is rotatably installed inside the belt cleaner frame 76 such that the secondary belt cleaning roller is in contact with the upper rear side of the primary belt cleaning roller 77.

The scraping blade 79 is formed in a substantially flat plate shape having a thickness in the vertical direction and extending in the left-right direction. The scraping blade 79 is supported in the belt cleaner frame 76 so as to come into contact with the secondary belt cleaning roller 78 from the upper rear side.

(3) Transferring Operation

Toner images carried on the surfaces of the photosensitive drums 18 by reversal development are sequentially and primarily transferred onto the upper portion of the intermediate transfer belt 86 moving from the rear side to the front side. As a result, a color image is formed on the intermediate transfer belt 86.

While a sheet P conveyed from the sheet feeding unit 3 passes a position where the intermediate transfer belt 86 faces the secondary transfer roller 88, the color image formed on the intermediate transfer belt 86 is secondarily transferred onto the sheet P.

(4) Cleaning Operation

In the printer 70, as described above, a sheet P is fed toward the image forming unit 4, and an image is formed thereon by passing a position where the intermediate transfer belt 86 and the secondary transfer roller 88 face each other.

After performing the image forming, the printer 70 collects (removes) substances such as paper dust and residual toner attached to the photosensitive drums 18 before the next image forming.

Specifically, it is likely for substances such as paper dust and residual toner to be attached to the photosensitive drum 18 of the black process unit 15K provided on the upstream side in the circulating direction of the intermediate transfer belt 86, as compared to the photosensitive drums 18 of the color process units 15.

Substances such as paper dust and residual toner attached to the photosensitive drum 18 of the black process unit 15K are scraped by the drum cleaning blade 33 and are retained inside the drum cleaner frame 32 through the opening 34.

Further, substances such as paper dust and residual toner attached to the photosensitive drums 18 of the color process units 15 are transferred onto the peripheral surfaces of the drum cleaning rollers 20 due to a cleaning bias applied to the drum cleaning rollers 20 when the attached substances face the drum cleaning rollers 20 by rotating of the photosensitive drums 18, and are temporarily held on the drum cleaning rollers 20.

Then, the substances such as paper dust and residual toner temporarily held on the drum cleaning rollers 20 are collected by the belt cleaning unit 75 during an image forming operation.

Specifically, first, a reverse bias of the cleaning bias is applied to the drum cleaning rollers 20. Then, the substances such as paper dust and residual toner temporarily held on the drum cleaning rollers 20 are released from the drum cleaning rollers 20 onto the intermediate transfer belt 86 through the photosensitive drums 18, thereby being collected.

Then, the substances such as paper dust and residual toner attached to the intermediate transfer belt 86 pass below the transfer unit 73 and reach the primary belt cleaning roller 77 by circulating of the intermediate transfer belt 86.

Then, the substances such as paper dust and residual toner having been released from the drum cleaning rollers 20 onto the intermediate transfer belt 86 are caught by the primary belt cleaning roller 77 due to the cleaning bias applied to the primary belt cleaning roller 77, are transferred onto the secondary belt cleaning roller 78, and are scraped by the scraping roller 79, thereby being stored in the belt cleaner frame 76.

(5) Advantages

According to the second exemplary embodiment, it is possible to move the drawer frame 14 from the inside position to the outside position as shown in FIG. 2.

In this case, in the black process unit 15K, many substances such as paper dust may be scraped off the photosensitive drum 18 by the drum cleaning blade 33. Therefore, the black process unit 15K may become heavier than the color process units 15.

However, even in this case, since the black process unit 15K is provided on the upstream side in the movement direction of the drawer frame 14 from the inside position to the outside position, when the drawer frame 14 is drawn out, the black process unit 15K is supported on the drawer unit 11 at a position close to the main body casing 2.

For this reason, it is possible to stably draw the drawer frame 14 out.

Further, even in the second exemplary embodiment, it is possible to achieve the same effects as those of the above-described first exemplary embodiment.

What is claimed is:

1. An image forming apparatus comprising:

a housing;

a first process unit provided inside the housing; and a second process unit provided inside the housing;

wherein the first process unit comprises:

a first photosensitive member configured to carry a first developer image to be transferred onto a transfer medium; and a blade member configured to scrape substances attached to a surface of the first photosensitive member off the surface of the first photosensitive member, and wherein the second process unit comprises:

a second photosensitive member configured to carry a second developer image to be transferred onto the transfer medium on which the first developer image has been transferred; and a holding member configured to:

remove substances attached to a surface of the second photosensitive member from the surface of the second photosensitive member;

temporarily hold the substances; and return the substances to the surface of the second photosensitive member.

2. The image forming apparatus according to claim 1, wherein the first process unit further comprises a retaining unit configured to retain the substances scraped by the blade member.

3. The image forming apparatus according to claim 2, wherein the first process unit further comprises a first developer accommodating unit configured to accommodate developer to be fed to the first photosensitive member, and wherein the first developer accommodating unit is removably mounted to the housing integrally with the retaining unit.

4. The image forming apparatus according to claim 3, wherein the second process unit further comprises a second developer accommodating unit configured to accommodate developer to be fed to the second photosensitive member, and wherein the second developer accommodating unit is removably mounted to the housing separately from the holding member.

5. The image forming apparatus according to claim 4, wherein the first developer accommodating unit of the first process unit is removably mounted to the housing integrally with the first photosensitive member, and wherein the second developer accommodating unit of the second process unit is removably mounted to the housing separately from the second photosensitive member.

6. The image forming apparatus according to claim 4, wherein the first process unit further comprises a first developer carrier configured to carry the developer fed from the first developer accommodating unit and to feed the developer onto the first photosensitive member, and wherein the first process unit comprising the first photosensitive member, the blade member, the retaining unit, the first developer accommodating unit and the first developer carrier are integrally mountable to or removable from the housing.

7. The image forming apparatus according to claim 1, wherein the first process unit further comprises a first charging member configured to come into contact with the first photosensitive member and charge the first photosensitive member, and wherein the second process unit further comprises a second charging member provided to face the second photosensitive member with a gap therebetween and configured to charge the second photosensitive member by discharge.

8. The image forming apparatus according to claim 7, wherein the first charging member is a charging roller.

9. The image forming apparatus according to claim 7, wherein the second charging member is a scorotron charger.

10. The image forming apparatus according to claim 1, further comprising:

an endless belt configured to face the first photosensitive member and the second photosensitive member and to collect substances having been returned from the holding member onto the surface of the second photosensitive member; and a belt cleaner configured to remove substances attached to the belt.

11. The image forming apparatus according to claim 1, further comprising:

a supporting member configured to support the first process unit and the second process unit, wherein the supporting member is movable between an inside position where the supporting member is provided inside the housing and an outside position where the supporting member is drawn out from the inside position, and support the first process unit and the second process unit, and wherein the first process unit is provided on an upstream side from the second process unit in a movement direction of the supporting member from the inside position to the outside position.

12. The image forming apparatus according to claim 1, wherein the blade member is a cleaning blade.

13. The image forming apparatus according to claim 1, wherein the holding member is a cleaning roller.

14. The image forming apparatus according to claim 1, further comprising:

a driving roller and a driven roller which are provided to face each other having a space therebetween; and an endless belt wound around the driving roller and the driven roller and is configured to face the first process unit and the second process unit, wherein the first process unit is provided to a position closer to the driven roller than the driving roller.

15. The image forming apparatus according to claim 14, further comprising:

a fixing unit configured to fix the first developer image and/or the second developer image onto the transfer medium, wherein the driving roller is provided between the driven roller and the fixing unit.

16. The image forming apparatus according to claim 14, further comprising:

an intermediate transfer roller facing the driven roller with nipping the belt therebetween.

* * * * *